United States Patent [19]

Nigris et al.

[11] Patent Number: 4,889,178

[45] Date of Patent: Dec. 26, 1989

[54] WITHDRAWAL AND DISCHARGE DEVICE FOR A VERTICAL CONTINUOUS CASTING MACHINE

[75] Inventors: Giovanni Nigris, Mereto di Tomba; Roberto Manera, Udine, both of Italy

[73] Assignee: Danieli & C. Officine Meccaniche SpA, Buttrio, Italy

[21] Appl. No.: 214,956

[22] Filed: Jul. 5, 1988

[30] Foreign Application Priority Data

Jul. 30, 1987 [IT] Italy ..... 83419 A/87

[51] Int. Cl.[4] ..... B22D 11/126; B22D 11/128

[52] U.S. Cl. ..... 164/448; 164/263; 164/447

[58] Field of Search ..... 164/441, 442, 447, 448, 164/154, 263

[56] References Cited

U.S. PATENT DOCUMENTS

| | | | |
|---|---|---|---|
| 4,081,021 | 3/1978 | Bills | 164/154 |
| 4,085,513 | 4/1978 | Capriotti et al. | 164/442 X |
| 4,173,251 | 11/1979 | Scheinecker | 164/442 X |
| 4,250,948 | 2/1981 | Feuchter et al. | 164/448 X |

FOREIGN PATENT DOCUMENTS

| | | |
|---|---|---|
| 1151354 | 7/1963 | Fed. Rep. of Germany . |
| 3027789 | 2/1982 | Fed. Rep. of Germany . |
| 1559859 | 2/1969 | France . |
| 2476513 | 8/1981 | France . |
| 919869 | 2/1963 | United Kingdom . |

*Primary Examiner*—Richard K. Seidel
*Assistant Examiner*—J. Reed Batten, Jr.
*Attorney, Agent, or Firm*—Wegner & Bretschneider

[57] ABSTRACT

Withdrawal and discharge device for a vertical continuous casting machine (10) which produces blooms within a field of weights ranging from one to at least twenty units of weight and with variations in speed of a support carriage (16) or foot with a field of speeds ranging from one to at least fifty units of speed, there being comprised in cooperation downstream of an ingot mould (11):

a plurality of withdrawal roll assemblies (29) of which at least one is working momentarily, and a support assembly (16–17) with a motor assembly (22), the drive and control of the individual withdrawal roll assemblies (29) and of the motor assembly (22) being obtained with individual hydraulic circuits fitted directly to the withdrawal roll assemblies (29) and motor assembly (22) so as to have quicker response times and greater repeatability.

7 Claims, 2 Drawing Sheets

WITHDRAWAL AND DISCHARGE DEVICE FOR A VERTICAL CONTINUOUS CASTING MACHINE

Figure 1:
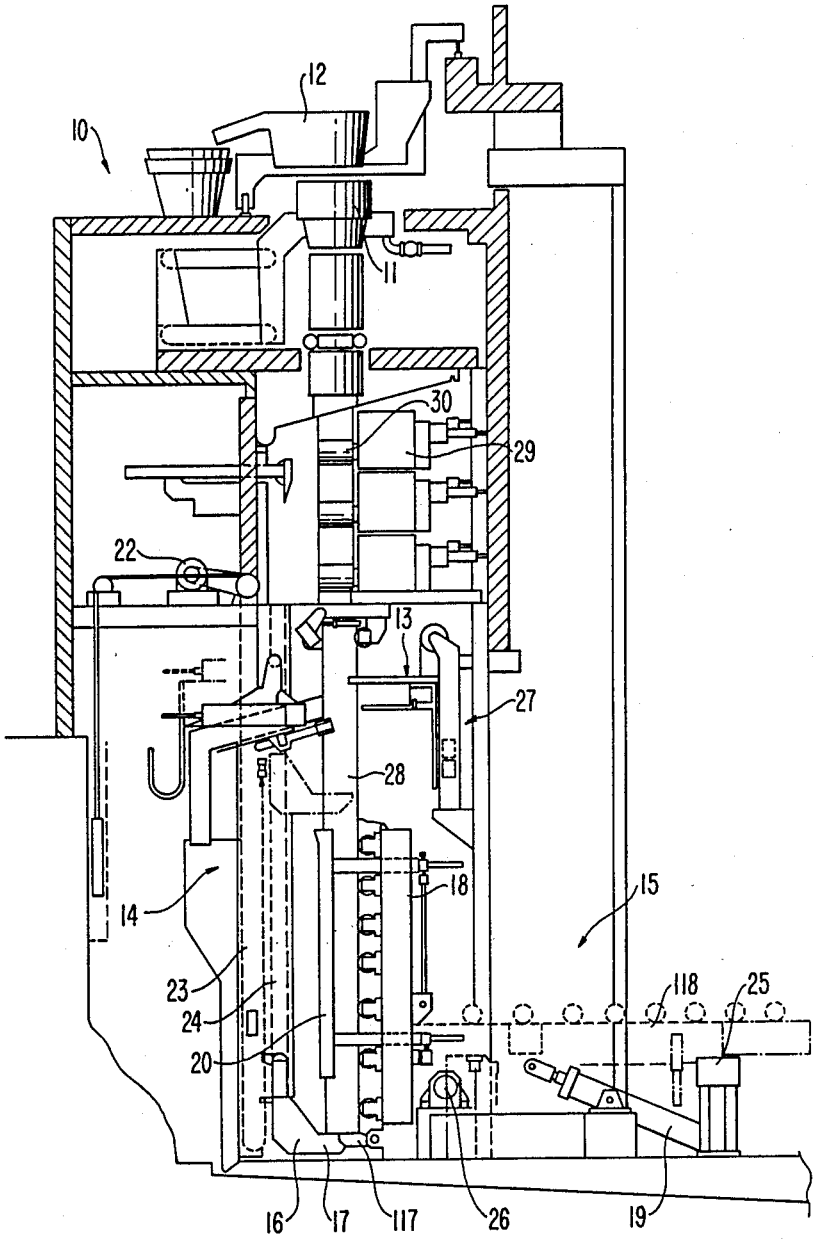

This invention concerns a device to withdraw and discharge blooms from a vertical continuous casting machine.

To be more exact, the invention concerns a device suitable to control the withdrawal and discharge of blooms by means of continuous, constant control of the position of the bloom being formed.

By the term "bloom" is meant here the widest range of products which can be obtained with a vertical continuous casting machine.

Vertical continuous casting machines are known in which the cast product descends vertically until it has cooled to the required value, and is then discharged.

Such vertical continuous casting machines comprise a withdrawal assembly which acts vertically and cooperates with withdrawal roll assemblies located immediately downstream of an ingot mould.

As we said above, the withdrawal roll assemblies are located immediately downstream of an ingot mould which cooperates with a tundish, for instance.

The problem to be tackled in vertical continuous casting machines is the constant control of the position of the bloom and, thereafter, of the proper discharge of the bloom.

Many methods and devices have been tested for the vertical control of the position of the bloom and for the discharge of the bloom.

The known systems have not been found satisfactory, above all when they have to work with a wide range of types of blooms to be produced. To be more exact, the known systems have been found unsatisfactory when the variation in weight between the smallest and the biggest blooms exceeds rather limited values.

In fact, when there are great variations in the speed of casting and in weight between the smallest and biggest blooms, the problems of control, drive and positioning become very difficult and the known art has still not produced a satisfactory answer.

Such problems begin to appear when the variation is equal to or exceeds a ratio of about one to ten.

Many systems have been tried, but at the present time it has been found that no system so far tested or embodied has enabled a perfect control of positioning to be obtained when large variations in the sizes of the bloom being formed are involved.

The mechanical systems do not enable satisfactory economical embodiments to be made available as regards the flexibility of this employment.

The hydraulic systems using cylinders (jacks) do not provide reliable embodiments since the ability to compress the oil and the relative response time are not satisfactory for this type of application.

FR-1559859 discloses a discharge device in which the bloom leaving the roller conveyor downstream of the ingot mould is controlled and braked by a plurality of pairs of rolls, each pair consisting of a powered roll and a free-turning roll.

In the case of light and very long blooms this plurality of pairs of rolls is able to cooperate satisfactorily but, where the blooms are very heavy and therefore of a modest length, this system is not efficient.

GB-A-919,869 discloses a system comprising a foot the position of which is controlled by rams. This system is not rigid enough and entails long and varying response times. Moreover, this text provides only for the foot. Besides, the dimensions of the rams have to be considerable besides entailing great quantities of oil.

The withdrawal and discharge device for a vertical continuous casting machine according to this invention is suitable to handle blooms having a variation up to forty times in weight as between their smallest and greatest dimensions.

Thus, for instance, if the smallest bloom is a square of 200×200 mm. and the biggest bloom is a square of 650×650 mm., the blooms will vary between a weight of 500 kgs. and more than 20,000 kgs., that is to say, the variation will range from about one to forty times.

The invention is therefore applicable when the vertical continuous casting machine has to be able to work in a very wide field of dimensional variables of the bloom and advantageously when such variable exceeds a value of twenty times.

According to the invention a support carriage is displaced vertically by a motor assembly at the same time as withdrawal roll assemblies, which regulate the speed of the bloom.

According to the invention the drive of the motor assembly and of the withdrawal roll assemblies is provided hydraulically.

The present applicant has found that by employing hydraulic actuation it is possible to obtain a plurality of advantages. Thus it is possible to obtain a very high degree of safety, an ability to repeat the product and great working reliability.

Moreover, it is possible to meet all demands quickly, such capability being possibly provided by a central computer, for instance the central computer of the continuous casting machine.

According to the invention the motor assembly comprises a hydraulic motor acting on a system of sprockets and chains which controls the ascent and descent of the support carriage or foot; this support carriage or foot serves to bear the cast material or bloom.

A withdrawal roll assembly is also included and comprises pairs of rolls actuated by jacks operated by a hydraulic circuit.

Three withdrawal roll assemblies are included advantageously since in this way it is possible to have only one withdrawal roll assembly or all three withdrawal roll assemblies working.

The jacks which actuate the rolls are operated by a hydraulic circuit, which itself too can be controlled by the computer.

According to the invention, when the cast product has been sheared by an oxyacetylene torch or other suitable means, the drive of the foot distances the two segments at once so as not to facilitate the adhesion of the two sheared ends.

A negative mechanical brake with hydraulic release is provided for the hydraulic motor of the motor assembly which operates the support carriage or foot, so that if the electric power or the hydraulic pressure fails, the brake will halt the hydraulic motor automatically.

All the oleodynamic valves are also fitted directly to the hydraulic motor so as to have a faster response time of the system and so as not to have problems with compression of the oil nor problems of pulsating thrusts in the oil pressure line.

According to the invention, the machine operator will set, according to the type and characteristics of the casting machine and according to the dimensions and quality of the product, on the central computer the values of speed and pressure, and the computer will control and regulate the functions of the whole hydraulic plant.

During the first portion of the descent of the bloom it is the bloom itself which thrusts the support carriage, which creates only a slight resistance.

When a shearing unit which follows the course of the bloom has sheared the bloom from the portion of the casting remaining above, the support carriage itself arranges to support the bloom and lowers the same at a first controlled speed to facilitate disengagement of the two sheared ends and then at a second controlled speed until it has placed the bloom on a support and discharge bench.

When the bloom has been placed on the support and discharge bench, the support carriage or foot rises swiftly and makes contact with the next bloom so as to reposition itself and wait.

The invention is therefore embodied with a withdrawal and discharge device for a vertical continuous casting machine.

Figure 2:
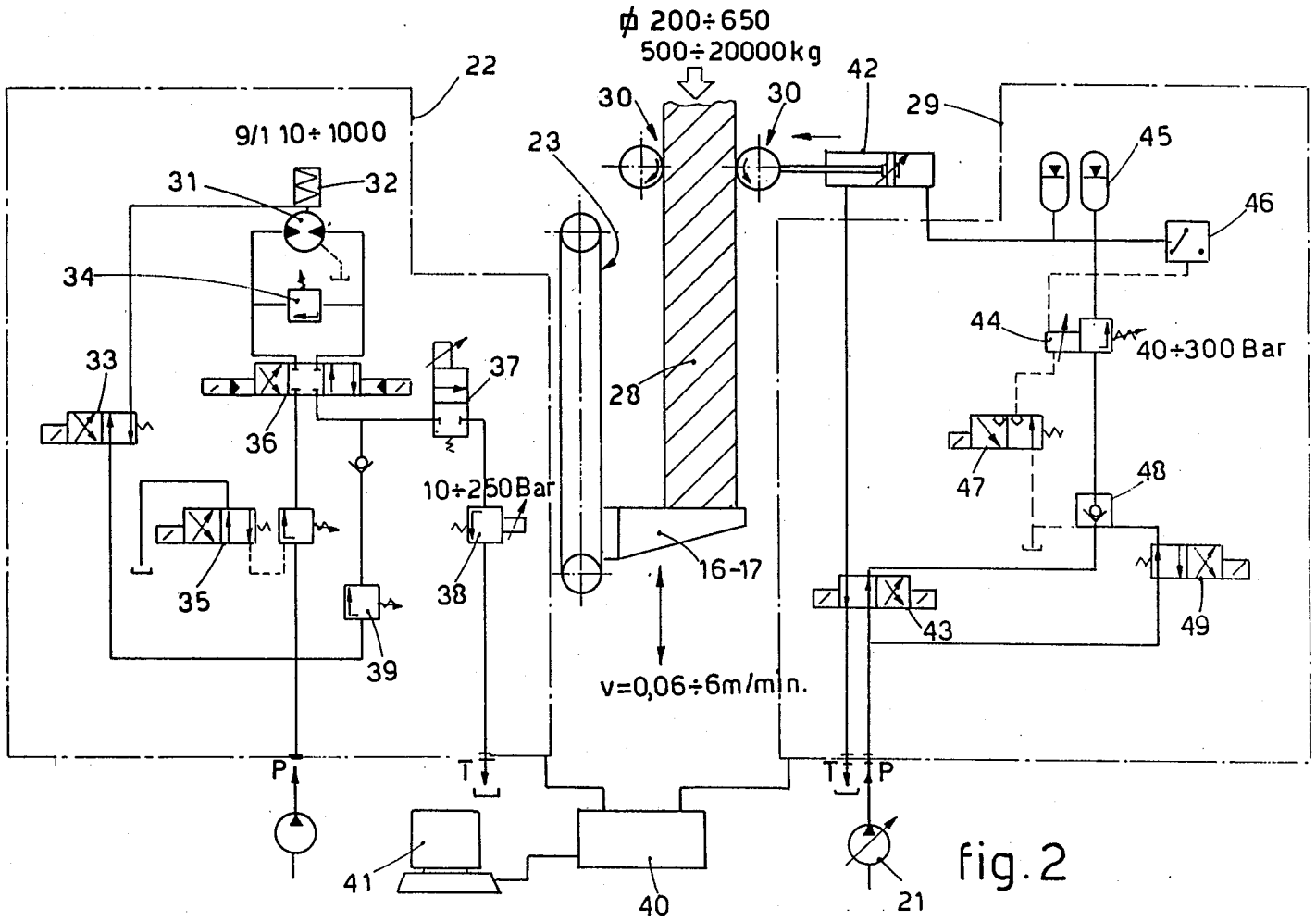

The attached figures, which are given as a non-restrictive example, show the following FIG. 1 gives a vertical diagrammatical view of a vertical continuous casting machine;

FIG. 2 shows a block diagram of the invention.

A vertical continuous casting machine 10 comprises a tundish 12 cooperating with an ingot mould 11, which in turn cooperates with withdrawal roll assemblies 29 containing withdrawal rolls 30.

A shearing lance 13 installed on a unit 27 which follows the course of the bloom, and a support frame 14 are located downstream of the withdrawal roll assemblies 29.

The support frame 14 cooperates with a discharge assembly 15, which comprises a two-positional support bench 18 able to rotate on a pivot 26 and moved by a jack 19, for instance.

A support stand 25 may be provided, and containing plates 20 may be comprised.

The support bench 18 comprises a support projection 117.

A support assembly 16–17 is actuated by a motor assembly 22 containing a motor 31 and in this example consists of a chain 23 cooperating with guides 24 in the vertical movement of a support carriage 16 which comprises a support foot 17.

The invention is applied to the motor assembly 22 and to each withdrawal roll assembly 29.

Single hydraulic circuits are fitted directly to the motor assembly 22 and withdrawal roll assemblies 29 so as to obtain faster response times and great repeatability.

The motor assembly 22 comprises the hydraulic motor 31 which controls the descent and ascent of the support carriage 16 which bears a bloom 28.

FIG. 2 shows some reference values for the case of blooms having a weight of about 20,000 kgs. at the most and a variation of about forty times as compared to the smallest bloom.

A hydraulically operated negative mechanical brake 32 is provided in connection with the motor 31 and is controlled by a first directional valve 33. If electric power or hydraulic pressure fails at any time, the brake 32 will halt the motor 31 automatically.

Next, the motor 31 is controlled by a safety valve 34 so as to prevent peaks of pressure in the motor.

Rotation of the motor 31 is controlled by a second directional valve 36, which in turn is fed by a pressure reduction valve 35 covering two pressure scales, one for the ascent of the support carriage 16 (high pressure) and the other for the descent of the support carriage (low pressure).

This pressure reduction valve 35 is of a direct one-stage type and of a compact modular type.

Instead, the speed of ascent and descent of the support carriage 16 is controlled by a proportional flow control valve 37.

A proportional pressure safety valve 38 is included to balance the weight of the bloom 28 and controls the pressure in the motor 31 on its bloom-support side.

The valves from position 35 to position 39 are fitted directly to the motor at positions 31 and 32 to obtain faster response times and avoid disturbances in the oil pressure circuit.

The proportional safety valve 38 advantageously has response times of about a hundred milliseconds.

According to the product to be cast, that is to say, according to the dimensions and quality of the bloom, the machine operator will set on a central computer 40 by means of a terminal 41 the values of speed and pressure for the proportional valves 37 and 38.

The computer 40 then sets the hydraulic equipment in a condition to await the bloom 28.

During the first portion of its descent the bloom 28 is left to thrust the support carriage 16 or foot, thus creating only a slight counterpressure.

When the bloom 28 has been sheared, the support carriage 16 is enabled to bear the bloom, lower it at a gradual speed and place it on the projection 117 for discharge in cooperation with the overturnable support bench 18.

As soon as this operation has ended, the support carriage 16 is brought upwards until it contacts the new bloom 28 and is arranged for its next cycle.

In the event of failure of the power supply or a breakdown in the electronic equipment, the whole system is blocked and remains at its maximum value of counterpressure so as to keep the support carriage 16 still even if very heavy loads are placed thereupon 16.

In fact, in such a case a series of valves 47, 48 and 49 is provided to prevent escape of oil from the main jacks 42 in the event of a power failure.

Let us now see the method of working of the withdrawal roll assemblies 29.

The case shown in FIG. 1 provides for three withdrawal roll assemblies 29 so as to be able to cover the whole range of possible situations envisaged.

Each withdrawal roll assembly 29 comprises a pair of rolls 30 controlled by a pressure jack 42, which keeps the pair of powered rolls 30 pressed against the bloom 28.

The roll 30 is driven by a D.C. motor which keeps the roll 30 at the required withdrawal speed.

Actuation of the pressure jack 42 is conditioned by a third directional valve 43.

A proportional-control pressure reduction valve 44 serves to regulate the pressure in the pressure jack 42 according to pre-set parameters.

A system of batteries 45 will be included advantageously so as to ensure that in the event of a power failure or a breakdown of a variable flow pump 21, the quantity of fluid is retained which is needed to keep the circuit under pressure for a pre-set time, for instance 30 minutes.

Next,a pressure transducer 46 is included to ensure feedback of control to the proportional valve 44 and computer 40.

A series of valves is also included, namely a poppet valve 47, retention valve 48 and poppet valve 49, to ensure that in the event of a power failure or breakdown of the variable flow pump 21 the fluid does not excape but remains constantly under pressure, thus ensuring the safety of the plant.

According to the product being cast, that is to say, according to the dimensions and quality of the bloom 28, the machine operator sets on the computer 40 the values of pressure for the proportional-control pressure reduction valve 44, and the computer 40 controls these values automatically by means of a transducer 46.

The computer 40 pre-arranges the withdrawal roll assembly 29 to support the cast product by means of the thrust of the pressure jack 42 and sets the descent speed of the roll 30.

In the event of a power failure or breakdown of the electronic or hydraulic equipment the system is set for an assured condition of safety for the required time, 30 minutes for instance, by the batteries 45.

We claim:

1. A withdrawal and discharge device for a vertical continuous casting machine that produces blooms from an ingot mold of a weight ranging from one to at least twenty units of weight and of varying lengths, said device comprising:

a plurality of withdrawal roll assemblies located downstream of said ingot mold, said roll assemblies each having at least a pair of rolls, and at least one of said roll assemblies operating at any given time;

a support frame supporting said blooms of varying weight and length said support frame being located downstream of said roll assemblies; a support assembly driven by a motor assembly for movement with respect to said support frame, said support assembly having a support carriage and a foot, the speed of said support carriage or foot ranging from one to at least fifty units of speed; and individual hydraulic circuits operably coupled to a corresponding one of said roll assemblies and said motor assembly to provide drive and control thereof.

2. Device as claimed in claim 1, in which the motor assembly comprises a hydraulic motor coupled to a negative mechanical brake controlled by a valve with hydraulic control means included.

3. Device as claimed in claim 1, in which the ascent and descent of the support carriage are controlled by a twoscale pressure reduction valve of a one-stage, direct, compact and modular type.

4. Device as claimed in claim 3, in which at least during a descent step of the support carriage with the bloom already sheared, the motor is controlled by a proportional safety valve and a proportional flow control valve with response times of about one hundred milliseconds.

5. Device as claimed in claim 1, in which the rolls cooperate with a pressure jack connected to batteries and controlled by a proportional-control pressure reduction valve .

6. Device as claimed in claim 5, in which the pressure jack is controlled by a pressure transducer linked to a computer .

7. Device as claimed in claim 6, in which a series of valves is included to prevent the escape of oil from the jacks in the event of a power failure.

* * * * *